US010925375B2

(12) United States Patent
Lefevre et al.

(10) Patent No.: US 10,925,375 B2
(45) Date of Patent: Feb. 23, 2021

(54) POT CAPABLE OF CONTAINING A SOLID, LIQUID OR PASTY PRODUCT

(71) Applicant: Parfums Christian Dior, Paris (FR)

(72) Inventors: Savine Lefevre, Compiegne (FR); François Gautier, Colombes (FR)

(73) Assignee: Parfums Christian Dior, Paris (FR)

( * ) Notice: Subject to any disclaimer, the term of this patent is extended or adjusted under 35 U.S.C. 154(b) by 34 days.

(21) Appl. No.: 16/336,538

(22) PCT Filed: Sep. 27, 2017

(86) PCT No.: PCT/FR2017/052615

§ 371 (c)(1),
(2) Date: Mar. 26, 2019

(87) PCT Pub. No.: WO2018/060610

PCT Pub. Date: Apr. 5, 2018

(65) Prior Publication Data

US 2020/0128940 A1 Apr. 30, 2020

(30) Foreign Application Priority Data

Sep. 28, 2016 (FR) ..... 1659184

(51) Int. Cl.
*A45D 40/00* (2006.01)
*A45D 34/00* (2006.01)
(Continued)

(52) U.S. Cl.
CPC ..... *A45D 40/0068* (2013.01); *A45D 33/006* (2013.01); *A45D 34/00* (2013.01);
(Continued)

(58) Field of Classification Search
CPC .. A45D 40/0068; A45D 34/00; A45D 40/221; A45D 40/222; A45D 2040/228;
(Continued)

(56) References Cited

U.S. PATENT DOCUMENTS 1,939,569 A 12/1933 Rudolf
3,087,641 A 4/1963 Millard
(Continued)

FOREIGN PATENT DOCUMENTS

DE 202012102080 7/2012
EP 2607258 6/2013
(Continued)

OTHER PUBLICATIONS

International Search Report for PCT/FR2017/052615 dated Dec. 18, 2017.

*Primary Examiner* — James N Smalley
(74) *Attorney, Agent, or Firm* — Thomas|Horstemeyer, LLP

(57) ABSTRACT

A pot (100) comprising a body (10) presenting a cavity with an opening (11*b*), and a lid (20) that is movable relative to the body (10). The body (10) has an engagement element (14*e*) and the lid (20) has a closure tab (70) movable between an engaged position in which, when the lid (20) is in a shut position in which the lid shuts the opening, the closure tab (70) co-operates with the engagement element (14*e*) and thus holds the lid (20) in the shut position, and a disengaged position in which the closure tab (70) does not co-operate with the engagement element (14*e*). The pot has a blocking tongue (42) movable between a locked position in which it blocks the closure tab (70) in the engaged position, and an unlocked position in which the closure tab (70) is movable between the engaged position and the disengaged position.

20 Claims, 10 Drawing Sheets

(51) Int. Cl.
*A45D 40/22* (2006.01)
*A45D 33/00* (2006.01)

(52) U.S. Cl.
CPC ..... *A45D 40/221* (2013.01); *A45D 40/222* (2013.01); *A45D 2040/228* (2013.01)

(58) Field of Classification Search
CPC ..... A45D 2200/051; A45D 2040/223; A45D 2040/224; B65D 50/04
See application file for complete search history.

(56) References Cited

U.S. PATENT DOCUMENTS

| | | | |
|---|---|---|---|
| 3,750,822 | A | 8/1973 | Dubach |
| 4,083,468 | A | 4/1978 | Batchelor |
| 5,222,619 | A | 6/1993 | Gregory |
| 5,908,037 | A | 6/1999 | Pierson |
| 6,935,507 | B1 | 8/2005 | Mecca et al. |
| 7,815,067 | B2 | 10/2010 | Matsumoto et al. |
| 7,832,564 | B2 | 11/2010 | Kim |
| 8,186,527 | B2 | 5/2012 | Liu |
| 9,061,804 | B2 | 6/2015 | Delage et al. |
| 2006/0283476 | A1 | 12/2006 | Bennett |
| 2007/0215494 | A1* | 9/2007 | Yuhara ..... A45D 33/006 206/37 |
| 2007/0241107 | A1 | 10/2007 | Matsumoto et al. |
| 2007/0274763 | A1* | 11/2007 | Domy ..... A45D 40/10 401/53 |
| 2010/0108676 | A1* | 5/2010 | Salciarini ..... A45D 40/22 220/263 |
| 2013/0161345 | A1 | 6/2013 | Tatin |
| 2013/0334230 | A1 | 12/2013 | Delage et al. |

FOREIGN PATENT DOCUMENTS

| | | | |
|---|---|---|---|
| EP | 3064447 | A1 | 9/2016 |
| FR | 808830 | | 2/1937 |
| FR | 917052 | | 12/1946 |
| FR | 2043878 | | 2/1971 |
| FR | 2701366 | A1 | 8/1994 |
| FR | 2882902 | | 9/2006 |
| GB | 677026 | | 8/1952 |
| GB | 1485106 | | 9/1977 |
| KR | 100999415 | | 12/2010 |
| KR | 20120015863 | | 2/2012 |
| WO | 2013065951 | | 5/2013 |

* cited by examiner

POT CAPABLE OF CONTAINING A SOLID, LIQUID OR PASTY PRODUCT

CROSS REFERENCE TO RELATED APPLICATIONS

This application is a § 371 national phase application of PCT Application No. PCT/FR2017/052615, entitled "POT CAPABLE OF CONTAINING A SOLID, LIQUID OR PASTY PRODUCT," filed Sep. 27, 2017, which claims the benefit of and priority to French Patent Application No. 1659184, filed Sep. 28, 2016, the contents of which being incorporated by reference in their entirety herein.

FIELD OF THE INVENTION

The present disclosure relates to a pot, and more particularly to a pot that is suitable for containing a substance that may be solid, liquid, or pasty. Such a pot may be used in particular for packaging cosmetics.

TECHNOLOGICAL BACKGROUND

By way of example, international publication WO 2005/039349 discloses a pot comprising a body presenting a cavity suitable for containing a substance that may be solid, liquid, or pasty, the cavity presenting an opening and a lid that is movable relative to the body, a first element from among the body and the lid including an engagement element, a second element from among the body and the lid including a closure tab movable between an engaged position in which, when the lid is in a shut position in which the lid shuts the opening, the closure tab co-operates with the engagement element, thereby holding the lid in the shut position, and a disengaged position in which the closure tab does not co-operate with the engagement element, so as to allow the lid to move relative to the body.

In the pot disclosed in WO 2005/039349, the engagement element and the closure tab are in the form of two hooks that engage each other. The closure tab is rigidly connected to a lateral pushbutton so that pressure exerted on the pushbutton causes the closure tab to go from the engaged position to the disengaged position, thereby enabling the lid to be opened. The pushbutton is returned by a spring.

In such a pot, the engagement of the closure tab in the engagement element is not very reliable and the pot can open in untimely manner, then spilling its content.

The invention seeks to remedy that drawback at least in part and to propose a pot in which retention in the shut position is more reliable.

SUMMARY OF THE INVENTION

This object is achieved by the fact that the pot comprises a blocking tongue that is movable between a locked position in which the blocking tongue blocks the closure tab in the engaged position, and an unlocked position in which the closure tab is movable between the engaged position and the disengaged position, and an actuator configured to move the blocking tongue between the locked position and the unlocked position.

In the locked position, the blocking tongue blocks the closure tab in the engaged position. Thus, no untimely movement of the closure tab is possible, whereby the closure tab co-operates effectively with the engagement element and holds the lid in the shut position in reliable manner. The shut position corresponds to the situation in which the pot is closed.

In some embodiments, the second element comprises the blocking tongue. The closure tab and the blocking tongue are thus provided on the same element selected from the body and the lid. This facilitates co-operation.

In some embodiments, the closure tab is movable in rotation. Compared with sliding, rotation leads to little friction, thereby reducing wear of the parts.

In some embodiments, the pot comprises return means configured to return the closure tab into the disengaged position. Thus, when the closure tab is blocked by the blocking tongue, it is held stationary independently of the return means and it remains in the engaged position. In contrast, when the blocking tongue is in the unlocked position and no longer blocks the closure tab, the closure tab is driven by the return means into the disengaged position. This facilitates opening the pot.

The return means may be a resilient element such as a spring, a magnet, or any other element suitable for exerting a return force.

In some embodiments, the pot comprises a stop part and, in the disengaged position, the closure tab is in abutment against said stop part. The stroke of the closure tab is thus defined accurately. Consequently, the space occupied by the closure tab remains limited, despite its various positions.

In some embodiments, the blocking tongue is rigidly connected to the actuator. It is thus actuated reliably, since a movement of the actuator results directly from a movement of the blocking tongue.

In some embodiments, the closure tab comprises a lug configured to co-operate with the blocking tongue. The presence of a lug makes co-operation between the blocking tongue and the closure tab more accurate.

In some embodiments, the actuator is a pushbutton that is movable in translation. In particular, when the blocking tongue is rigidly connected to the actuator, the blocking tongue is movable in translation in the direction in which the actuator moves in translation.

The pushbutton may be situated in the second element, i.e. in the same element from among the body and the lid as the closure tab.

A return element such as a spring may be configured to urge the pushbutton into its rest position after it has been actuated.

In some embodiments, the pushbutton comprises a push wall and a slide wall that is substantially perpendicular to the push wall, the blocking tongue being formed on the slide wall. The push wall is the wall that is to receive the pressing force for actuating the pushbutton. The slide wall may define the direction in which the pushbutton slides when a force is exerted transversely on the push wall.

In some embodiments, the pot further comprises a cradle, the pushbutton co-operating with the cradle via a cam having a heart-shaped path. The cam with a heart-shaped path is described in greater detail below. In this way, the pushbutton is movable between two stable positions. If a return element tends to move the pushbutton away from the cradle, the pushbutton passing between the two stable positions is caused by presses applied to the pushbutton, where appropriate to its push wall.

In some embodiments, the pushbutton comprises a skirt co-operating with a skirt of the cradle. For example, the skirts may co-operate by sliding one against the other when the pushbutton is moved in translation relative to the cradle.

The presence of such skirts limits any resonance caused by the movement of the pushbutton.

In some embodiments, the first element is the body and the second element is the lid. The mechanism for opening the pot, including in particular the closure tab and the actuator, if any, is thus housed in the lid.

In some embodiments, the first element and the second element are articulated to each other, e.g. by means of a hinge.

In some embodiments, the lid further comprises a sealing gasket. The sealing gasket may be situated around the opening. The sealing gasket thus provides sealing between the opening and the lid that shuts the opening when in the shut position.

In some embodiments, the actuator is configured to compress the sealing gasket, in particular axially, when the blocking tongue is in the locked position or passes into the locked position. Compression may take place indirectly via a part that is itself actuated by the actuator. Thus, passage of the blocking tongue into the locked position and the corresponding locking of the pot are accompanied by the cavity being sealed as a result of the sealing gasket being actuated in corresponding manner, optionally simultaneously.

In addition, the actuator may be configured to leave the sealing gasket at rest when the blocking tongue is in the unlocked position.

More generally, the gasket may be configured to provide sealing against a surface that is normal to its compression direction.

BRIEF DESCRIPTION OF THE DRAWINGS

The invention and its advantages can be better understood on reading the following detailed description of embodiments of the invention given as non-limiting examples. The description refers to the accompanying drawings, in which.

DETAILED DESCRIPTION OF THE INVENTION

Figure 1:
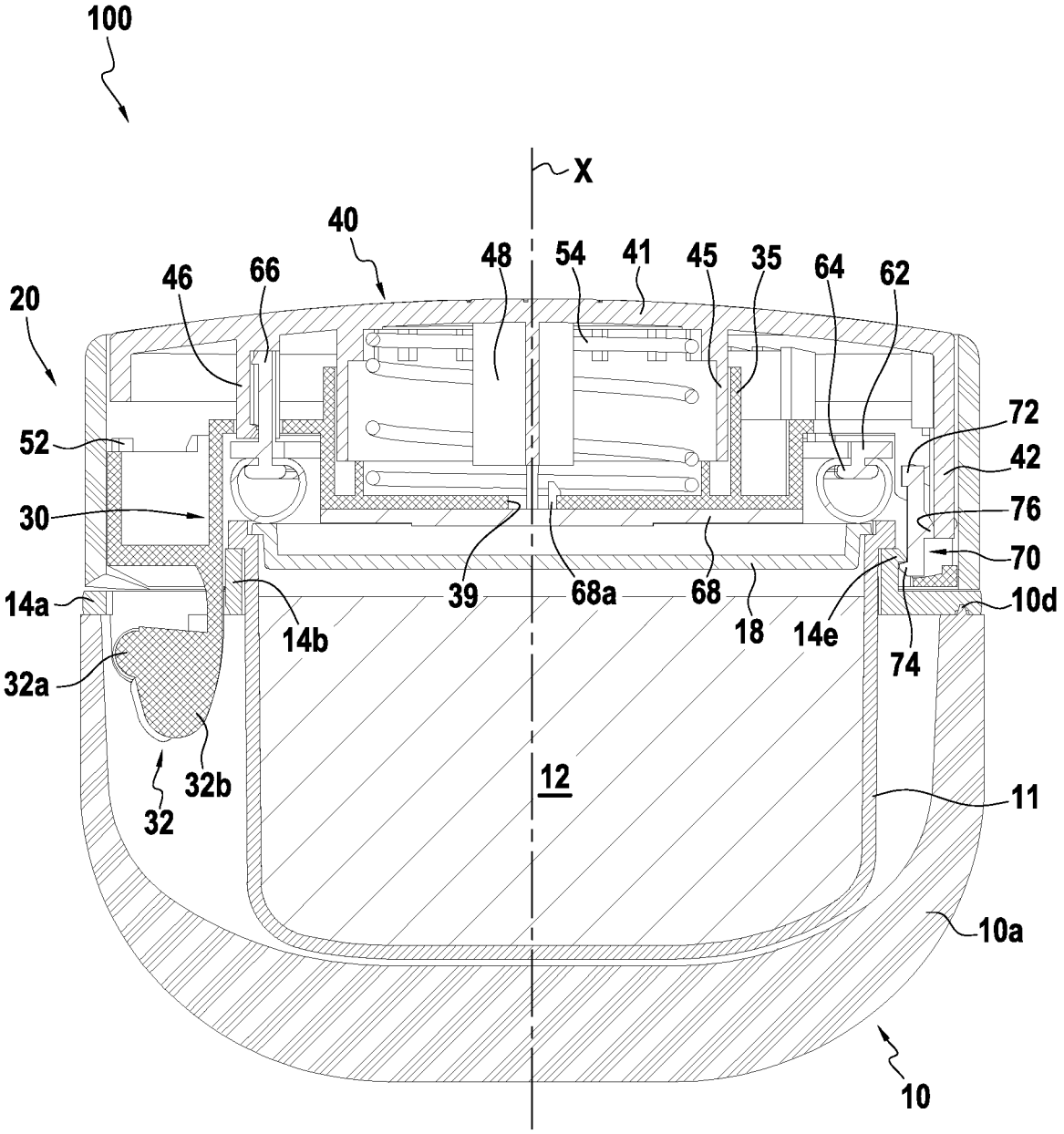
FIG. 1 is a section view of a first embodiment of a pot, the closure tab being in the engaged position.

The structure of a pot constituting a first embodiment of the invention is described in detail with reference to FIGS. 1 to 4.

As mentioned above, FIG. 1 is a section view of a pot 100 comprising a body 10 and a lid 20 that is movable relative to the body 10. In the present embodiment, the body 10 forms a first element in the meaning of the invention, while the lid 20 forms a second element. Nevertheless, the opposite configuration could apply. In the description below, without loss of generality and for reasons of clarity, reference is made solely to the body 10 and to the lid 20, as opposed to the first and second elements.

The body 10 presents a cavity suitable for containing a substance 12 that may be solid, liquid, or pasty, the cavity presenting an opening. In this case, the body comprises trim 10*a* in which a vessel 11 is arranged. The vessel 11 comprises a rim 11*a* and is opened via an opening 11*b* (see FIG. 2A).

The lid 20 may be positioned in a shut position in which the lid 20 shuts the opening 11*b*. The pot 100 is then considered to be closed. This is the position shown in FIG. 1. The body 10 also comprises a plate 14 with a peripheral portion 14*a* that is substantially annular in this example and a shoulder 14*b* provided radially inside the peripheral portion 14*a*. The term "substantially annular" is used to mean a shape that is substantially continuous and that may be substantially circular, elliptical, oval, or the like. Starting from the peripheral portion 14*a*, the shoulder 14*b* projects towards the opening 11*b*.

The plate 14 further comprises indexing elements 14*d* (see FIG. 2B) for co-operating with corresponding indexing elements 10*d* (see FIG. 2A) provided on the trim 10*a*, for the purpose of positioning and fastening the plate 14 on the trim 10*a*.

As shown in FIG. 1, the rim 11*a* of the vessel 11 bears against the shoulder 14*b* of the plate 14 in such a manner that the vessel is suspended in the trim 10*a*. The vessel 11 is configured to contain the solid, liquid, or pasty substance 12.

Optionally, the body 10 may comprise a membrane seal 18. As shown in FIG. 1, the membrane seal 18 is for closing the opening 11*b* so as to protect the substance 12. The membrane seal 18 may bear against the rim 11*a* of the vessel 11, e.g. against a shoulder provided for that purpose.

The lid 20 comprises a cradle 30 and a pushbutton 40. The lid 20, and in this example more precisely the cradle 30, may comprise a hinge 32 for hinging the lid 20 to the body 10. In this case, the hinge 32 comprises pins 32*a* and a masking portion 32*b*. The pins 32*a* are configured to receive rods 17. Furthermore, the rods 17 are configured to be inserted in pin-supports 15 provided on the plate 14. Thus, the articulation of the pins 32*a* relative to the pin-supports 15 forms a hinge. The resulting hinge is pivotable about the axis defined by the rods 17.

The pin-supports 15 project from the peripheral portion 14*a* towards the inside of the trim 10*a*. The plate 14 has an orifice 14*c* for insertion of the hinge 32, thus enabling the hinge 32 to be put into alignment with the pin-supports 15. The masking portion 32*b* is configured to mask the orifice 14*c* and the pins 32*a*, in particular when the pot 100 is in the open position. For this purpose, the masking portion 32*b* is offset relative to the rods 17 defining the pivot axis of the hinge 32 towards the side from which the pot 100 opens.

Figure 2A:
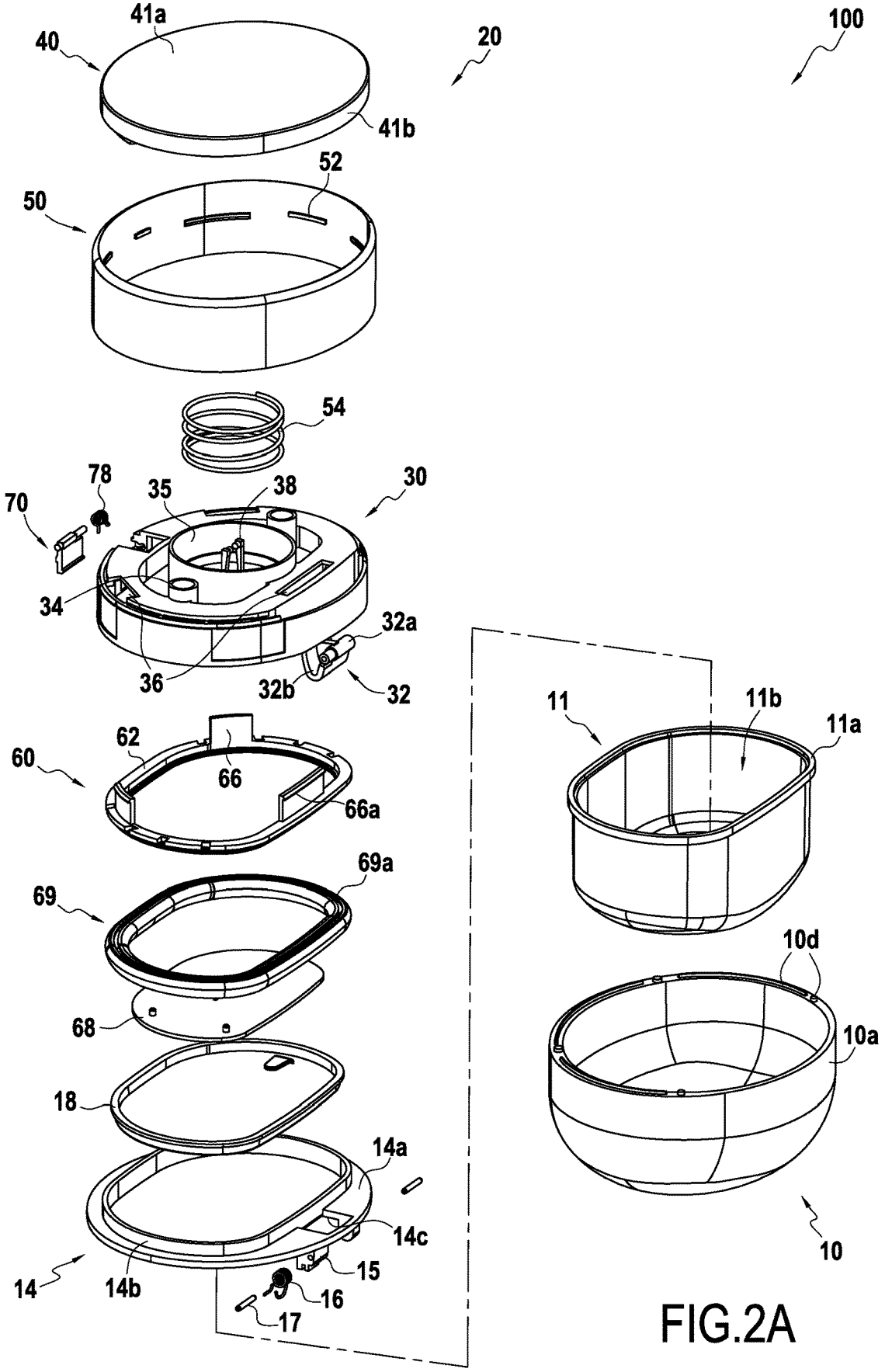
FIG. 2A is an exploded perspective view of the FIG. 1 pot.
Figure 2B:
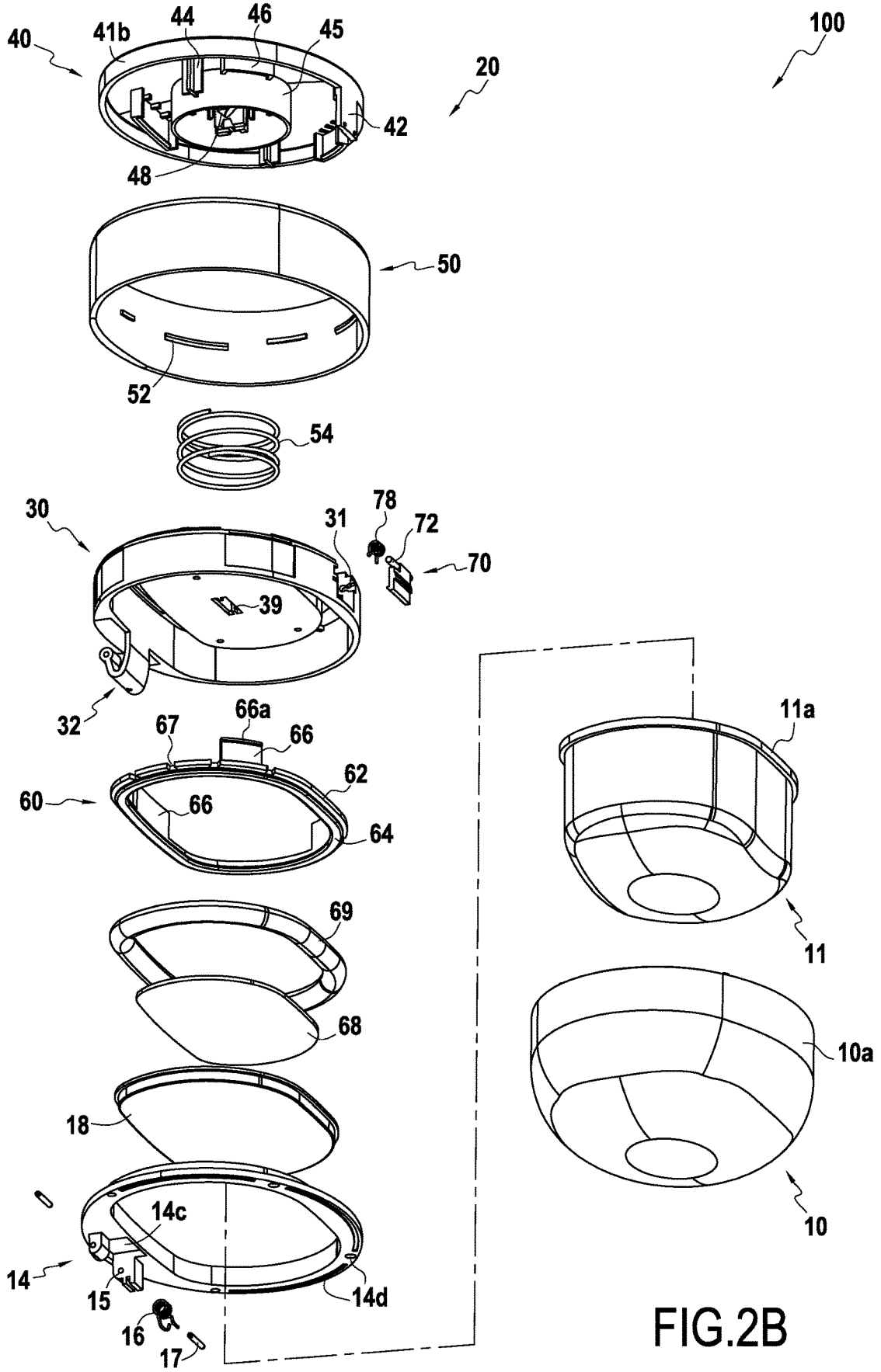
FIG. 2B is similar to FIG. 2A, with a different perspective angle.

The pins 32*a* are configured to receive a return element, here a spring 16. In this case, as shown in FIG. 2A each pin 32*a* comprises a thin portion on which a spring 16 is received. The spring 16 provides torsion between the pins 32*a* and the pin-supports 15. Thus, the spring 16 constitutes return means configured to urge the lid 20 towards an open position of the pot 100, i.e. to move the lid 20 away from its shut position relative to the body 10.

The cradle 30 co-operates with a pushbutton 40. The pushbutton 40 comprises a push wall 41*a* and a slide wall 41*b* that is substantially perpendicular to the push wall 41*a*. The pushbutton 40, and more particularly its push wall 41*a* lies on the outside of the lid 20. As described above, and as shown in FIG. 3, a blocking tongue 42 is formed on the slide wall 41*b*. The blocking tongue 42 is described in greater detail below.

The pushbutton 40 also comprises protuberances 44 suitable for co-operating with guides 34 of the cradle 30. In this case, the protuberances 44 are rods of cross-shaped cross-section. In this example, the guides 34 are hollow cylinders of inside diameter that is equal to or slightly less than the width of the cross-shaped section. In this case, the cradle 30 comprises two guides 34 and the pushbutton 40 comprises two corresponding protuberances 44. The protuberances 44 are configured to be inserted in the guides 34 so as to form a slideway connection configured to guide the pushbutton 40 relative to the cradle 30.

Furthermore, the cradle 30 and the pushbutton 40 comprise respective skirts 35 and 45 configured to co-operate so as to form a slideway connection. The skirt 35 of the cradle 30 projects towards the pushbutton 40. The skirt 45 of the pushbutton 40 projects towards the cradle 30. In the present embodiment, the skirts 35 and 45 are cylindrical. As can be seen in FIG. 1, the radially outer surface of the skirt 45 of the pushbutton 40 slides along the radially inner surface of the skirt 35 of the cradle 30. Co-operation between the skirts 35 and 45 serves to attenuate vibration and resonance due to the pushbutton 40 moving relative to the cradle 30.

Figure 3:
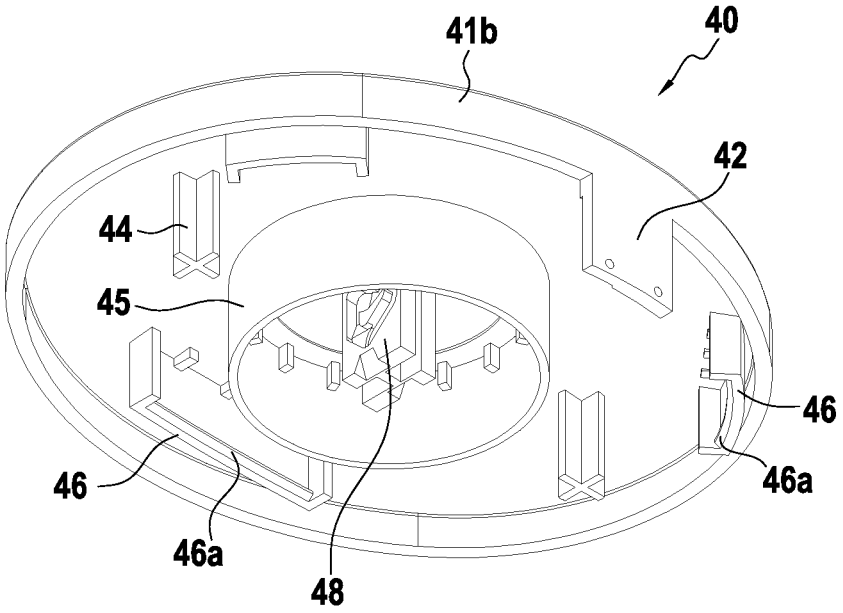
FIG. 3 is a detail view in perspective of the pushbutton in the first embodiment.
Figure 5:
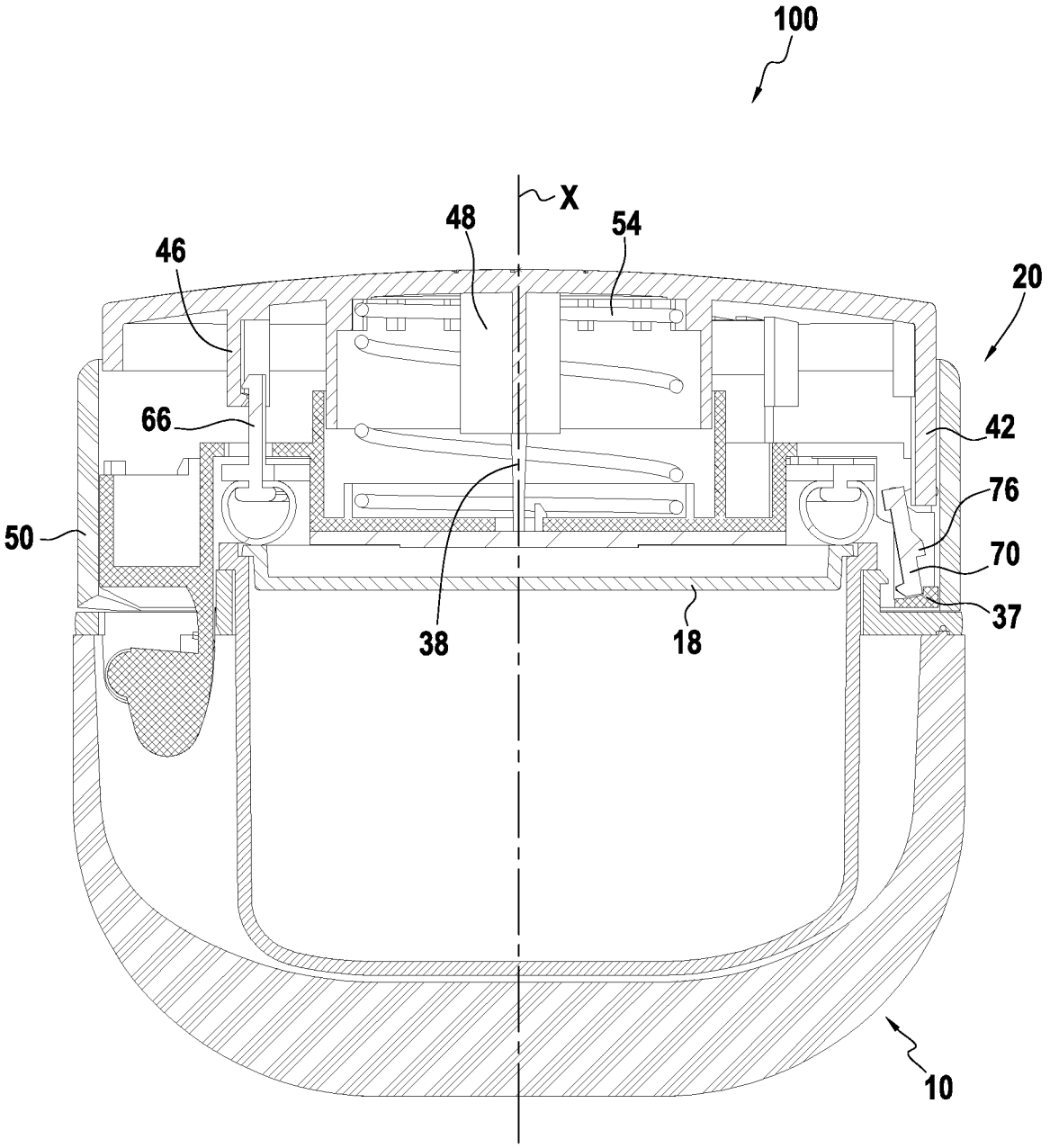
FIG. 5 is a section view of the first embodiment of the pot, the closure tab being in the disengaged position.

In addition, and as can be seen in FIG. 3, the pushbutton 40 comprises first slideway elements 46, here three first slideway elements 46. The number of first slideway elements 46 could be greater or smaller. The first slideway elements 46 project towards the cradle 30. The distal ends of the first slideway elements 46 have respective abutment-forming shoulders 46*a*. As shown in FIG. 5, a shoulder 46*a* also possesses a shape that enables it to be assembled by snap-fastening with the two slideway elements 66 that are described below.

The pushbutton 40 and the cradle 30 co-operate by moving in translation relative to each other. In other words, the pushbutton 40 is movable in translation, in this case in the direction in which the slide wall 41*b* extends, here perpendicularly to the push wall 41*a*. The direction in which the pushbutton 40 moves in translation is referenced X in FIG. 1 and it corresponds to the axis of the lid 20. In the present embodiment, the lid axis X extends in the vertical direction when the pot 100 is closed in its normal utilization position, i.e. when the opening 11*b* looks upwards. Unless specified to the contrary, axial, radial, and transverse directions are specified below relative to the lid axis X.

The cradle 30 and the pushbutton 40 co-operate via a cam having a heart-shaped path. For this purpose, the cradle comprises at least one cam arm 38, and specifically two in this example (see FIG. 2A). The cam arms 38 are situated radially inside the skirt 35. The pushbutton 40 comprises at least one heart-shaped path 48, and specifically two in this example (see FIG. 3). The heart-shaped paths 48 are situated radially inside the skirt 45. In addition, a return element—in this example in the form of a spring 54 mounted in compression between the cradle 30 and the pushbutton 40, in this example inside the skirts 35 and 45—tends to urge the pushbutton 40 away from the cradle 30. The operation of the cam with a heart-shaped path is described in detail below.

The lid 20 further comprises a ring 50. In this embodiment, the ring 50 is substantially annular. The ring 50 forms the lateral outer periphery of the lid 20. As can be seen in FIG. 1, the slide wall 41*b* of the pushbutton 40 slides along the radially inner surface of the ring 50.

The ring 50 comprises catches 52 (see FIG. 2A) enabling the ring 50 to be fastened on the cradle 30 by snap-fastening. The slide wall 41*b* is suitable for coming into abutment against the catches 52. In this example, the catches 52 are arranged inside the ring 50 around a circumference. Provision may be made for there to be only one catch 52 or for there to be a plurality of catches 52. When there is only one catch, the catch 52 needs to be interrupted at least to allow the blocking tongue 42 to pass through, which tongue projects from the slide wall 41*b* below the catches 52, as can be seen in FIG. 1.

The lid 20 further comprises an insert 60. The insert 60 comprises an insert body 62 from which there projects a rail 64. The rail 64, and possibly also the insert body 62, has a shape in cross-section relative to the lid axis X that substantially matches the shape of the opening 11*b*. In addition, the insert 60 comprises second slideway elements 66, there being three second slideway elements 66 in this example. The number of second slideway elements 66 could be greater or smaller. The second slideway elements 66 project towards the pushbutton 40. The distal ends of the second slideway elements 66 are provided with respective abutment-forming shoulders 66*a*, and as described above, these shoulders are configured to enable them to be assembled with the first slideway element 46 by snap-fastening.

The second slideway elements 66 are suitable for co-operating with the above-described first slideway elements 46. Their complementary shapes enabling them to move in translation relative to one another can be seen in FIG. 1. Although the pushbutton 40 and the insert 60 are on opposite sides of the cradle 30, windows 36 formed in the cradle 30 (see FIG. 2A) in register with the first and second slideway elements 46 and 66 enable the first and second slideway elements 46 and 66 to be put into contact and to co-operate with one another.

By co-operating, the first and second slideway elements 46 and 66 define a stroke in translation for the pushbutton 40 relative to the insert 60. For example, the shoulder 46*a* is movable in translation between the shoulder 66*a* and the insert body 62.

The insert 60 may be assembled to the cradle 30 beside the body 10. For example, assembly may be performed by engaging crenellations 67 of the insert 60 on corresponding elements of the cradle 30.

The lid 20 further comprises a mask 68. As shown in FIG. 1, the mask 68 may come into contact with the cradle 30. The mask 68 may be fastened on the cradle 30 by means of a fastener element, e.g. a snap-fastening arm 68*a* co-operating with a fastener slot 39 of the cradle 30. The free surface of the mask 68, i.e. its bottom surface in FIG. 1, is seen by the user of the pot 100 when the pot 100 is open, i.e. when the lid 20 is spaced apart from the body 10. This surface may carry ornamentation.

The lid 20 further comprises a gasket 69 in the form of a hollow torus. The gasket 69 comprises a slot 69*a* enabling it to be mounted on the rail 64 of the insert 60. In this embodiment, the slot 69*a* runs all along the gasket 69. Once mounted, and insofar as the shape of the gasket 69 matches the shape of the opening 11*b*, the gasket 69 seals the closure provided by the membrane seal 18, as can be seen in FIG. 1.

The gasket 69 is configured to provide sealing that is axial, i.e. sealing along the direction of the axis X of the lid 20. In other words, the gasket 69 provides sealing at a surface that is normal to the axis X of the lid 20.

Furthermore, the gasket 69 may be configured to provide sealing in its direction of compression, i.e. sealing against a surface normal to its direction of compression. In the example of FIG. 1, the gasket 69 may be compressed axially, in this example by the insert 60 moving axially, and it then provides axial sealing, in this example against the membrane seal 18 and the rim 11*a*.

As mentioned above, the lid 20 further comprises a closure tab 70. The closure tab 70 comprises a pivot 72 configured to be received in a corresponding orifice 31 in the cradle 30. Thus, the closure tab 70 is mounted to pivot about the pivot 72 relative to the cradle 30. In the present embodiment, the pivot 72 is perpendicular to the lid axis X. In this example, the pivot 72 is placed at one end of the closure tab 70.

At its end opposite from the pivot 72, the closure tab 70 comprises a hook 74. The term "hook" 74 is used to designate any shape suitable for engaging with a corresponding engagement element 14*e*, here as provided on the plate 14. The hook 74 is provided on the side of the closure tab 70 that is closest to the body 10, while the pivot 72 is provide on the side of the closure tab 70 that is furthest from the body 10, i.e. in this example the closest to the pushbutton 40.

The closure tab 70 further comprises a lug 76 projecting radially relative to the lid axis X towards the blocking tongue 42. The lug 76 comprises a chamfered surface facing the blocking tongue 42 and the press wall 41*a*.

The lid 20 is also provided with return means configured to urge the closure tab 70 into the disengaged position, i.e., and as mentioned above, into a position in which the closure tab 70 does not co-operate with the engagement element 14*e*. In the present embodiment, the return means comprise a spring 78. The spring 78 is mounted with twisting between the cradle 30 and the closure tab 70 so as to cause the closure tab 70 to pivot away from the engagement element 14*e*.

As an alternative, or in addition, the return means could comprise a magnet, or indeed weights for causing the closure tab to tilt under gravity when the pot 100 is in its normal utilization position.

Figure 4:
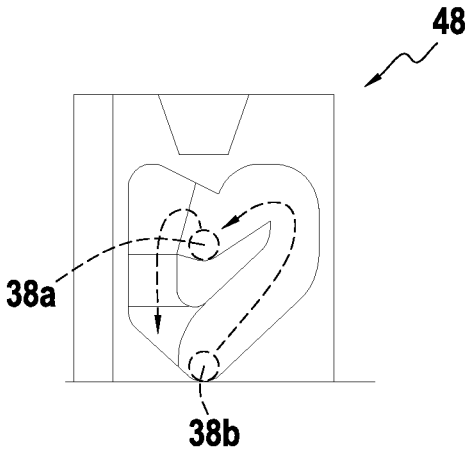
FIG. 4 shows the heart-shaped path used in the first embodiment.

The operation of the pot 100 is described below with reference to FIGS. 1, 4, and 5.

FIG. 1 shows a state in which the pot 100 is in the shut position: the lid 20 shuts the opening 11*b* independently of the membrane seal 18. The closure tab 70 is in an engaged position in which the closure tab 70 co-operates with the engagement element 14*e* and thus holds the lid 20 in the shut position. Furthermore, the blocking tongue 42 is in a locked position in which the blocking tongue 42 blocks the closure tab 70 in the engaged position. Specifically, as can be seen in FIG. 1, any turning of the closure tab 70 about its pivot 72 is impossible, since the lug 76 is pressed against the blocking tongue 42. The pot 100 is thus securely closed.

In this embodiment, the pushbutton 40 acts as an actuator that is configured to move the blocking tongue 42 between the locked position and the unlocked position.

When a user seeks to unlock the pot 100, the user presses on the press wall 41*a* of the pushbutton 40 in order to activate the actuator. The user exerts axial pressure along the lid axis X. Before pressing, the cam arms 38 are in the first stable position 38*a* shown in FIG. 4. By pressing on the pushbutton 40, against the return effect of the spring 54, the cam arms 38 follow the heart-shaped path 48 in the direction of the arrows in FIG. 4 so as to reach the second stable position 38*b*. The pushbutton 40 is then in the position shown in FIG. 5.

As shown in FIG. 5, pressing on the pushbutton 40 enables the pushbutton 40 to move in translation along the lid axis X away from the body 10. The pushbutton 40 is thus moved away from the body 10 by the spring 54, until it is held by the cam with the heart-shaped path.

The blocking tongue 42, which is constrained to move in translation with the pushbutton 40, also moves away from the body 10. In so doing, it is no longer in contact with the lug 76, nor more generally with the closure tab 70. The blocking tongue 42 is thus in an unlocked position, in which the closure tab 70 is movable between the engaged position and the disengaged position. Under urging from the spring 78, the closure tab 70 pivots and passes from the engaged position to the disengaged position shown in FIG. 5. In this position, the closure tab 70 does not co-operate with the engagement element 14*e* and the user is free to open the pot 100. In this case, opening of the pot 100 is assisted, and possibly automatic, as a result of the presence of the spring 16, which urges the lid 20 to leave its shut position.

As shown in FIG. 5, the cradle 30 comprises a stop part 37 that is provided in such a manner that when the closure tab 70 is in the disengaged position, the closure tab 70 is in abutment against the stop part 37. Thus, together with the engagement element 14*e*, the stop part 37 defines the rotary stroke of the closure tab 70. The stop part 37 limits turning of the closure tab 70 so that its passage from the disengaged position to the engaged position can be driven easily by the blocking tongue 42, as described below.

In order to reclose and lock the pot 100, the user can place the lid 20 in the shut position, and then press on the pushbutton 40 acting as an actuator. In so doing, the cam arms 38 pass from the second stable position 38*b* to the first stable position 38*a* following the direction of the arrows shown in FIG. 4. When pressure is applied to the pushbutton 40, the blocking tongue 42 is moved towards the body 10. In this movement, the blocking tongue 42 co-operates with the lug 76 and tends to replace the closure tab 70 in the engaged position, against the effect of the spring 78. When the first stable position 38*a* is reached once more, the situation is once more as shown in FIG. 1: the lid 20 is in the shut position, the closure tab 70 is in the engaged position, and the blocking tongue 42 is in the locked position.

FIGS. 6 to 10 show the pot in another embodiment. In these figures, elements that correspond to or are identical with elements of the first embodiment are given the same reference signs, apart from the hundred digit, and they are not described again.

Figure 6:
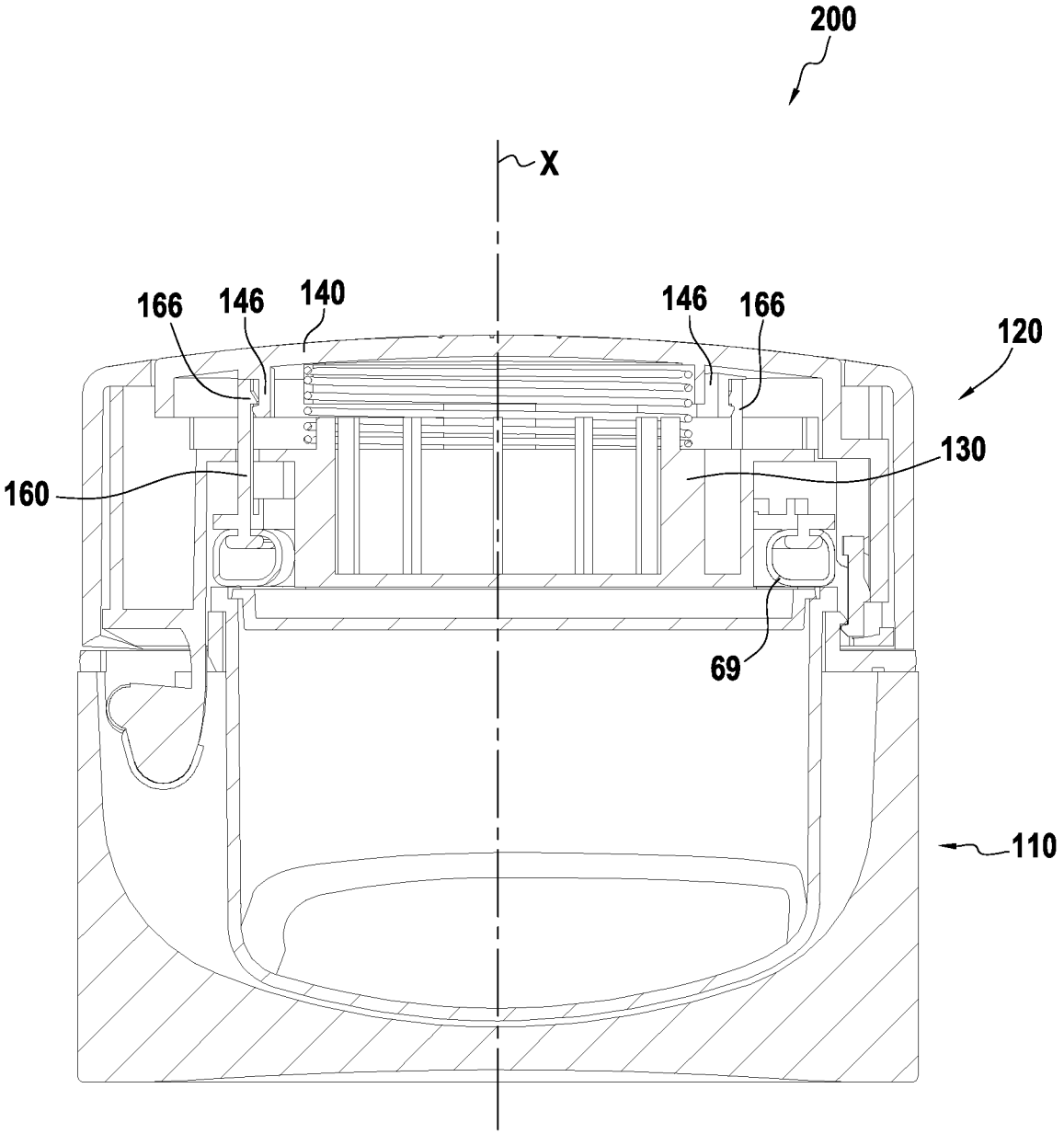
FIG. 6 is a section view of a second embodiment of a pot, the closure tab being in the engaged position.

FIG. 6 shows a second embodiment of a pot 200. This embodiment differs from the first essentially in the way the cradle 130, the pushbutton 140, and the insert 160 co-operate. Instead of first and second slideway elements 46 and 66, the pushbutton 140 and the insert 160 comprise respective first and second snap-fastener elements 146 and 166 that are mounted to be stationary relative to one another. Thus, in this embodiment, the insert 160 is constrained to move in translation together with the pushbutton 140, and in particular along the lid axis X.

Figure 7:
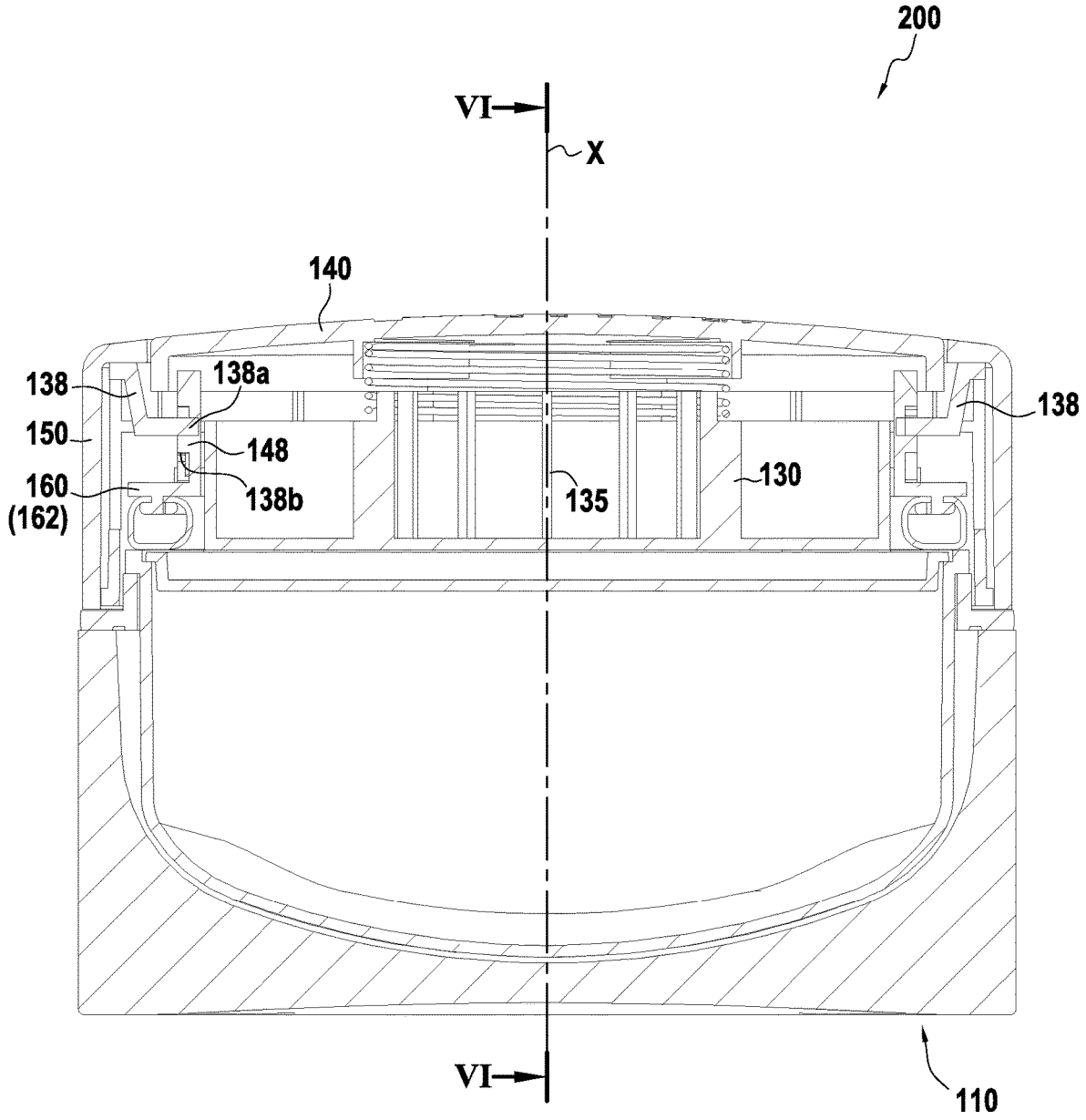
FIG. 7 is a view of the second embodiment of the pot, in section perpendicular to the section plane of FIG. 6.
Figure 10:
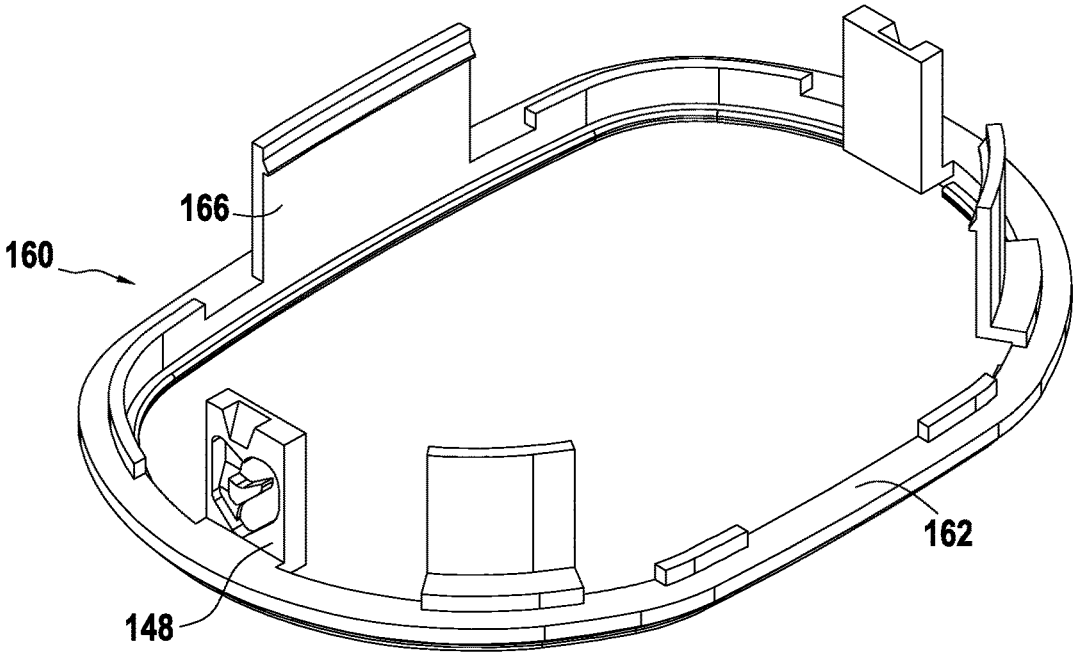
FIG. 10 is a detail view in perspective of an insert as provided in the second embodiment.

Furthermore, and as can be seen in FIG. 7 (of which FIG. 6 is a section view on plane VI-VI), and also in the perspective view of FIG. 10, the heart-shaped paths 148 are no longer provided on the pushbutton 140, but rather on the insert 160. The cam arms 138 are still provided on the cradle 130, but at the periphery of the cradle 130, outside the skirt 135.

Figure 8:
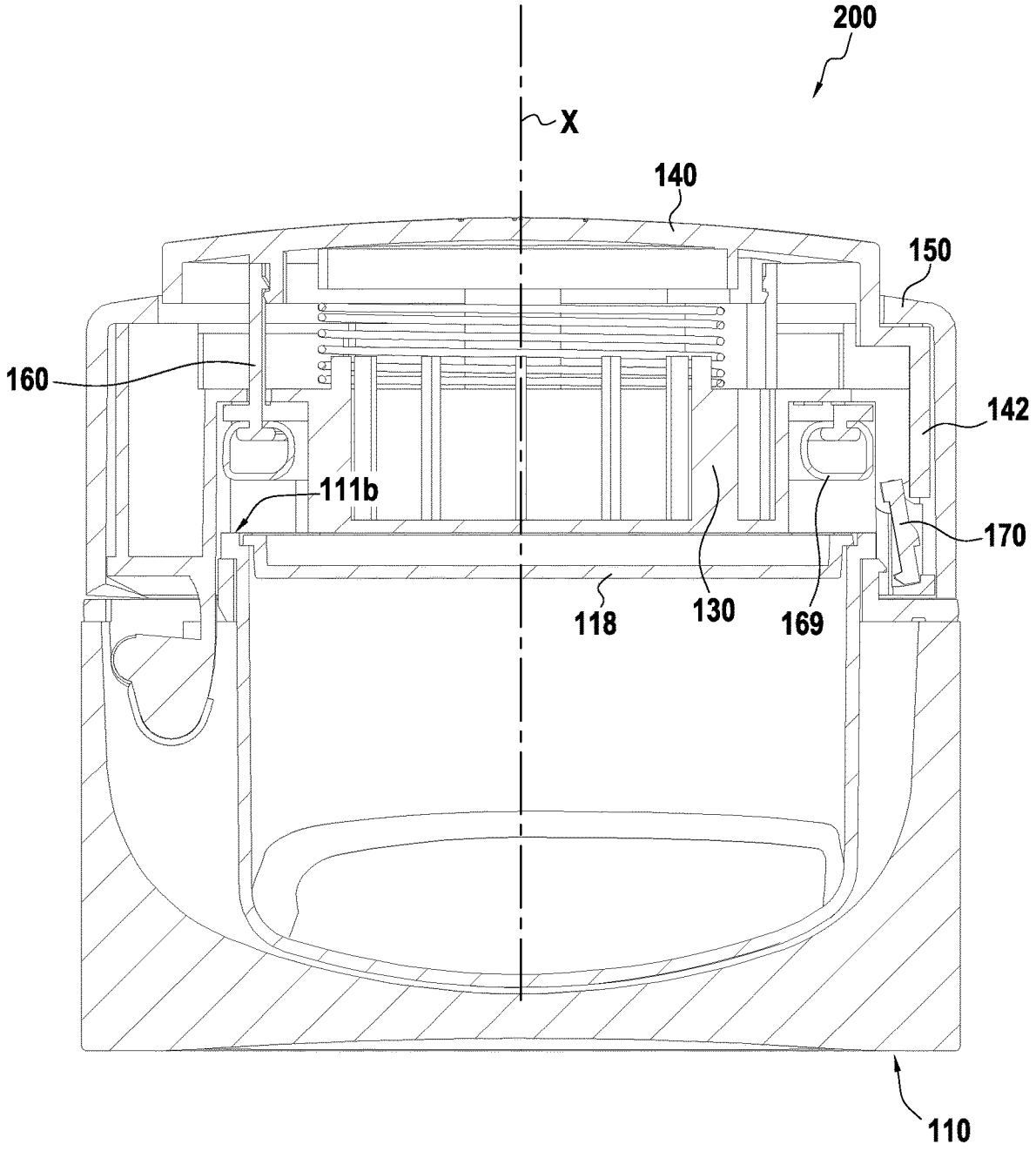
FIG. 8 is a section view of the second embodiment of the pot, the closure tab being in the disengaged position.

By pressing on the pushbutton 140, the cam arms 138 go from the first stable position 138*a* to the second stable position 138*b*, thus causing the blocking tongue 142 to pass into the disengaged position shown in FIG. 8. FIG. 8 is a view on a plane similar to the plane of FIG. 6. The closure tab 170 is in the disengaged position. In addition, the insert 160 has moved away from the body 110, thereby disengaging the gasket 169 away from the opening 111*b*, and from the membrane seal 118, if any. In other words, as can be seen in FIGS. 6 and 8, the gasket 169 is constrained to move in translation with the pushbutton 140, in this example via the insert 160.

Figure 9:
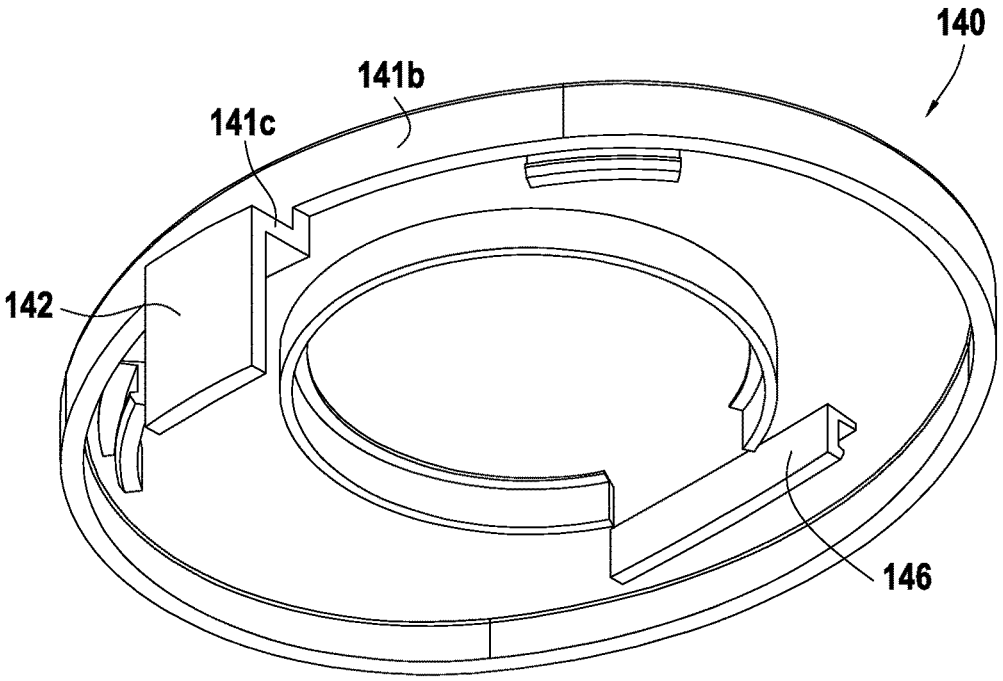
FIG. 9 is a detail view in perspective of a pushbutton as provided in the second embodiment.

FIG. 9 is a perspective view of the pushbutton 140 in the second embodiment. In addition to the characteristics already described, it should be observed that the blocking tongue 142 presents a radial offset 141*c* at its junction with the slide wall 141*b*. This offset 141*c* seeks to compensate for the ring 150 projecting radially inwards (see FIG. 8). As shown in FIG. 6, in the locked position of the blocking tongue, the push wall 141*a* of the pushbutton 140 is level with the radial projection of the ring 150, which is adjacent thereto.

As shown in FIG. 10, the insert 160 is very similar to the insert 60 of the first embodiment, apart from the presence of the heart-shaped path 148. In addition, since the insert 160 is movable relative to the cradle 130 it does not comprise an element corresponding to the crenellations 67.

Figure 11:
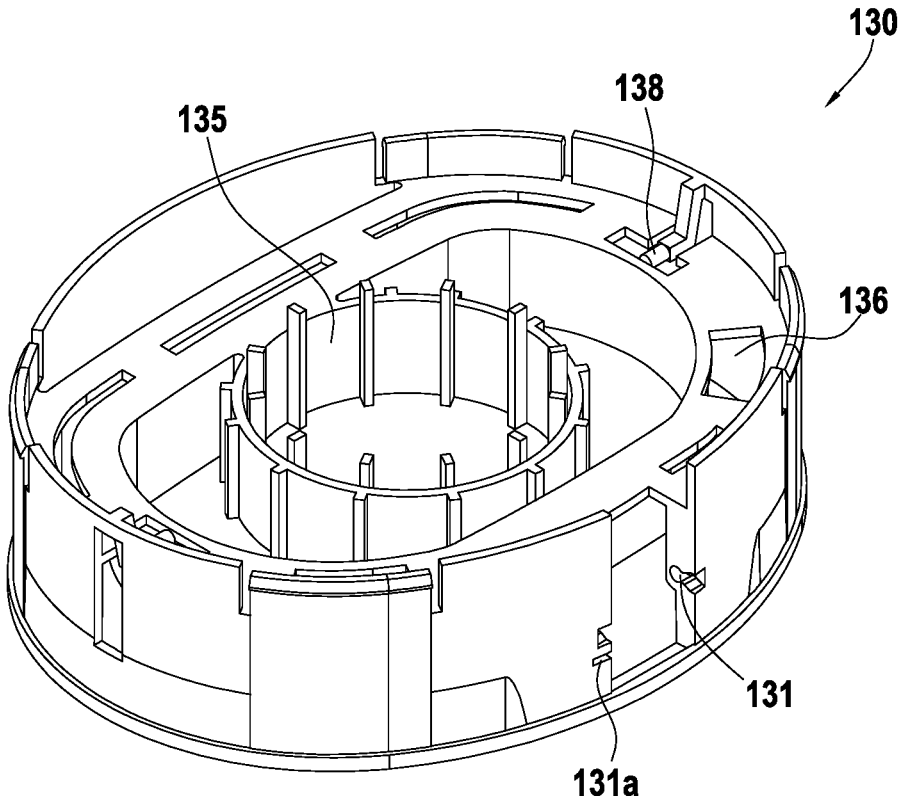
FIG. 11 is a detail view in perspective of a cradle provided in the second embodiment.

FIG. 11 is a perspective view of the cradle 130. In this figure, the orifice 131 for pivotally receiving the closure tab 170 can itself be seen particularly clearly. In the proximity of the orifice 131 there is provided a notch 131*a* that is configured to act as a bearing point for the spring 78. A similar notch may be provided in the first embodiment (see FIG. 3).

As can be seen in FIGS. 6 and 8, the pot 200 does not comprise a mask similar to the mask 68. The surface of the cradle 130 facing the body 110 is a solid surface that may itself be ornamented.

In addition, the cradle 130 does not comprise guides similar to the guides 34. Likewise, the pushbutton 140 does not comprise guides similar to the protuberances 44. Insofar as the cam arms 138 are provided on the outside of the skirt 135 and are diametrically opposite, they are spaced apart sufficiently to provide sufficient guidance to the pushbutton 140 and the insert 160 relative to the cradle.

Although the present invention is described with reference to specific embodiments, modifications may be made to those embodiments without going beyond the general ambit of the invention as defined by the claims. In particular, individual characteristics of the various embodiments shown and/or described may be combined in additional embodiments. Consequently, the description and the drawings are to be considered in a sense that is illustrative rather than restrictive.

The invention claimed is:

1. A pot, comprising:

a body presenting a cavity suitable for containing a solid, liquid, or pasty substance, the cavity presenting an opening and a lid that is movable relative to the body;

a first element from among the body and the lid comprising an engagement element;

a second element from among the body and the lid comprising a closure tab movable between an engaged position in which, when the lid is in a shut position in which the lid shuts the opening, the closure tab co-operates with the engagement element, thereby holding the lid in the shut position, and a disengaged position in which the closure tab does not co-operate with the engagement element, so as to allow the lid to move relative to the body;

a blocking tongue that is movable between a locked position in which the blocking tongue blocks the closure tab in the engaged position, and an unlocked position in which the closure tab is movable between the engaged position and the disengaged position; and an actuator configured to move the blocking tongue between the locked position and the unlocked position.

2. The pot according to claim 1, wherein the closure tab is movable in rotation.

3. The pot according to claim 1, further comprising return means configured to return the closure tab into the disengaged position.

4. The pot according to claim 1, further comprising a stop part, wherein, in the disengaged position, the closure tab is in abutment against the stop part.

5. The pot according to claim 1, wherein the blocking tongue is rigidly connected to the actuator.

6. The pot according to claim 1, wherein the closure tab comprises a lug configured to co-operate with the blocking tongue.

7. The pot according to claim 1, wherein the actuator is a pushbutton that is movable in translation.

8. The pot according to claim 7, wherein the pushbutton comprises a push wall and a slide wall that is substantially perpendicular to the push wall, the blocking tongue being formed on the slide wall.

9. The pot according to claim 1, wherein the first element is the body and the second element is the lid.

10. The pot according to claim 1, wherein the body and the lid are articulated to each other via a hinge.

11. The pot according to claim 1, wherein the lid further comprises a sealing gasket, and the actuator is configured to compress the sealing gasket axially when the blocking tongue is in the locked position.

12. A method, comprising:

providing a pot, the pot comprising:

a body presenting a cavity suitable for containing a solid, liquid, or pasty substance, the cavity presenting an opening and a lid that is movable relative to the body;

a first element from among the body and the lid comprising an engagement element;

a second element from among the body and the lid comprising a closure tab movable between an engaged position in which, when the lid is in a shut position in which the lid shuts the opening, the closure tab co-operates with the engagement element, thereby holding the lid in the shut position, and a disengaged position in which the closure tab does not co-operate with the engagement element, so as to allow the lid to move relative to the body;

a blocking tongue that is movable between a locked position in which the blocking tongue blocks the closure tab in the engaged position, and an unlocked position in which the closure tab is movable between the engaged position and the disengaged position; and an actuator configured to move the blocking tongue between the locked position and the unlocked position.

13. The method according to claim 12, wherein the closure tab is movable in rotation.

14. The method according to claim 12, wherein the pot further comprises return means configured to return the closure tab into the disengaged position.

15. The method according to claim 12, wherein the pot further comprises a stop part, wherein, in the disengaged position, the closure tab is in abutment against the stop part.

16. The method according to claim 12, wherein the blocking tongue is rigidly connected to the actuator.

17. The method according to claim 12, wherein the closure tab comprises a lug configured to co-operate with the blocking tongue.

18. The method according to claim 12, wherein the actuator is a pushbutton that is movable in translation, wherein the pushbutton comprises a push wall and a slide wall that is substantially perpendicular to the push wall, the blocking tongue being formed on the slide wall.

19. The method according to claim 12, wherein the first element is the body and the second element is the lid.

20. The method according to claim 12, wherein the lid further comprises a sealing gasket, and the actuator is configured to compress the sealing gasket axially when the blocking tongue is in the locked position.

* * * * *